United States Patent [19]

Brockway

[11] 3,995,887

[45] Dec. 7, 1976

[54] METHOD AND SYSTEM FOR CONTROL OF MULTIPLE INVENTORIES

[75] Inventor: Brock F. Brockway, Mill Valley, Calif.

[73] Assignee: E. D. Bullard Company, Sausalito, Calif.

[22] Filed: Apr. 7, 1975

[21] Appl. No.: 565,347

[52] U.S. Cl. ..... 283/55; 355/40

[51] Int. Cl.[2] ..... B42D 15/00

[58] Field of Search ..... 283/55, 1 A, 66, 18–20; 355/40, 3 R, 7, 11, 16

[56] References Cited

UNITED STATES PATENTS

| | | | |
|---|---|---|---|
| 922,948 | 5/1909 | Portmore | 283/20 |
| 1,916,282 | 7/1933 | Peacock | 355/40 |
| 3,603,681 | 9/1971 | Bortolotti | 355/40 X |
| 3,619,573 | 4/1971 | Phillip | 355/40 |

*Primary Examiner*—Lawrence Charles
*Attorney, Agent, or Firm*—Phillips, Moore, Weissenberger, Lempio & Strabala

[57] ABSTRACT

A system for monitoring the contents of a plurality of different inventories at different locations, such as for monitoring the contents of a plurality of first aid kits, some of which have different contents from others. The system includes a plurality of pairs of charts each having first and second regions thereon. The first regions contain printed matter common to all inventories or kits. Each pair of charts is associated with a single inventory or kit and the second regions thereon contain special printed matter i.e. printed matter pertinent only to the kit or inventory with which such charts are associated, normally consisting primarily of a predetermined list of such inventory or kit.

2 Claims, 8 Drawing Figures

METHOD AND SYSTEM FOR CONTROL OF MULTIPLE INVENTORIES

BACKGROUND AND SUMMARY OF INVENTION

The present invention relates to a method and system for maintaining control of inventory of a variety of items in a plurality of inventory locations where some of the inventories consist of different selections of items than others. More particularly, the present invention refers to a method and system for maintaining control over the contents of a plurality of first aid kits or the like, where some of those kits contain different selections of items than others. In this regard, the present invention provides a relatively simple and convenient means for assuring that the contents of each first aid kit are routinely checked by a suitable monitor, such as a physician, before being sent out on the job; for assuring that the contents will be regularly replaced when necessary; and for complying with U.S. and government requirements in connection with each of the foregoing.

Further, one particular aspect of the present invention relates generally to a method of printing high quality printed matter so as to permit portions of the printed matter to be revised without reprinting the entire composition thereby enabling portions of a prarticular composition to be revised inexpensively.

Thus, the present inventon has three aspects, as follows:

a. a system utilizing printed inventory charts for improved multiple inventory control, particularly for industrial first aid kits;

b. a technique for providing multiple alternate versions of printed matter at low cost; and c. combinations of the foregoing.

The present invention will be illustrated by reference to controlling the contents of a plurality of industrial first aid kits, some of which may have different contents or "fills" than others, or where the fills of the kits may change from time to time.

Heretofore, first aid kits used in industry or by public institutions have had their contents gradually diminished by use or decomposition, and have been maintained for periods of time in this diminished condition so that, on occasion, necessary and even critical first aid supplies have not been available when needed. Recently, legislation has been enacted in the United States to counteract this problem by requiring certain classes of employers to check the contents of first aid kits on a routine basis.

The present invention provides methods and systems for such employers to easily and conveniently monitor the contents of the kits on a regular basis.

It is thus an object of the present invention to provide a system whereby the contents of the kits can be monitored conventiently.

Another object of the present invention is to provide record evidence that the employer has complied with applicable law.

A further object of the present invention is to provide a method of monitoring a plurality of different inventories at different locations, such as may be desirable in maintaining regular levels of goods at different locations as in rack jobbing, or in maintaining constant levels of parts inventories at different repair stations.

An additional object of the present invention is to provide a method whereby first aid fill charts or the like can be of expensive high quality, relatively expensive, printing, but whereby the portions of the charts on which the fill selections are printed can be revised from time to time or from location to location by means of low cost xerographic printing without re-printing the fill charts in their entireties.

Still another object of the present invention is to provide high quality printed matter which can be revised relatively inexpensively especially in relatively small quantities.

These and other objects will be more apparent from the specification and claims herein.

DETAILED DESCRIPTION OF DRAWINGS

Figure 1:
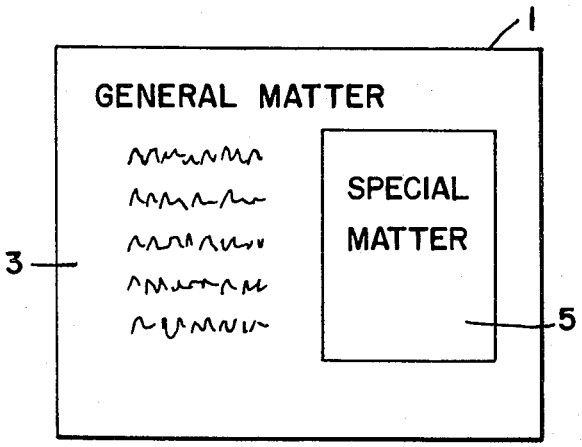
FIG. 1 is a diagram of a first chart bearing general printed matter and special printed matter, such first chart relating to a system for monitoring the ocntents of a number of first aid kits with dfferent fills.

Referring to FIG. 1, there is shown a first printed chart 1 designed to accompany one of a number of industrial first aid kits. This chart has a first region 3 in which is printed general information such as first aid instructions, legal requirements for fill maintenance, etc.. This general information is common to each first aid kit. Additionally, the chart 1 is provided with a secon region 5 in which is printed special information applicable to one particular first aid kit, but not necessarily applicable to the others. Special information contained in the second region 5 of chart 1 would normally consist, for example, primarily of a list of the contents or fill which it is desired to maintain in that particular kit. By comparing the contents of the kit with the items listed in the second region 5 of the chart 1, a monitor or other person may determine which items are missing and should be replenished. This first printed chart 1 is intended to accompany the particular first aid kit to which its special information applies. Preferably, the first printed chart 1 would be placed inside the kit by the monitor.

Additionally, there is provided a second printed chart 7 having a first region 9 bearing certain information and/or providing a space for the monitor to sign thereby indicating that he has checked the contents of the kit. additionally, the second chart 7 includes a second region 11 wherein special information is printed, which will normally be a duplicate of the information appearing in the second region of the first chart 1, i.e. a predetermined list of contents to be maintained in the particular first aid kit with which the first chart is associated.

In operation, the monitor would first examine a particular kit by comparing its actual contents with the items listed on te associated first and second charts 1, 7. Positive identification of asociation between charts 1, 7 and kits can be provided by marking both the kits and the charts 1, 7 with serial numbers. When the monitor discovers listed items missing, depleted or spoiled, he replaces them, or makes arrangements to have them replaced by others. The first chart 1 can be premanently kept with the kit; or it can be brought to the kit by the monitor, in which case it is preferably left at the kit until the monitor's next inspection, when it would be replaced with a new first chart. The second chart is then signed by the monitor or provided with other indicia that the above inspection has occurred whereupon the second chart is forwarded to a central filing location or other clearing house for record retention with second charts associated with other kits and/or which relate to prior inspections of the same kit. This same series of steps is carried out with respect to other kits and repeated on a routine basis with respect to all kits.

Figure 3:
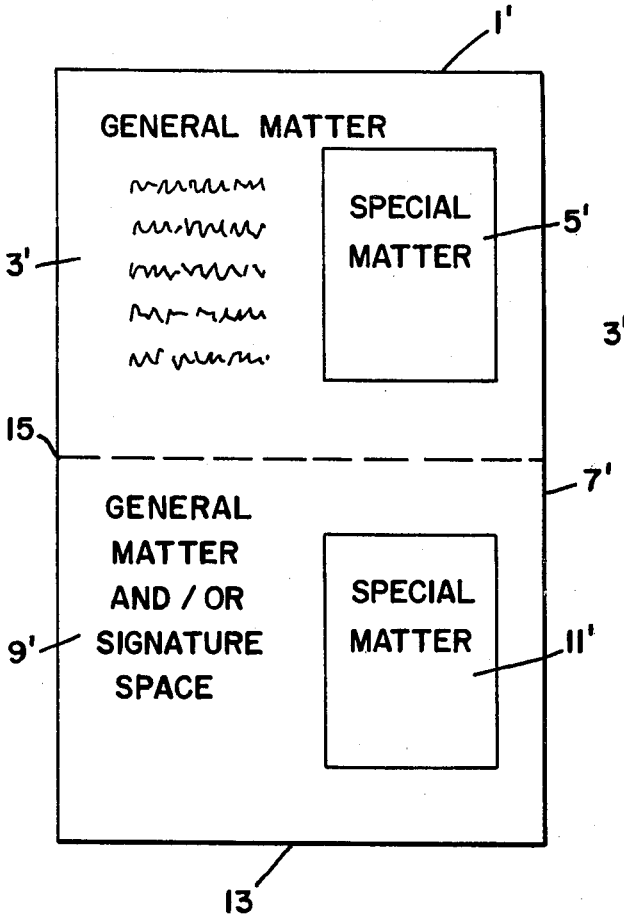
FIG. 3 is an alternate embodiment of the charts illustrated in FIGS. 1 and 2, wherein said charts are printed on a single sheet for subsequent detachment from one another.

An alternate embodiment of the above system is shown in FIG. 3 wherein common elements are provided with common numerals, once primed. The distinguishing characteristic of this embodiment is that first and second charts 1' and 7' appear on a single sheet 13 and are suited for detachment from one another along a divider line 15 running between them, which may or may not be perforated. In this embodiment, the first and second charts 1' and 7' are carried to the kit by the monitor who checks the kit contents as above. The second chart 7' is then detached from the first chart 1'. The monitor may mark or sign the second chart 7', or his mere act of detaching it from the first chart 1' and returning it to the clearing house or the like can serve as indicia that inspection has been carried out.

Figure 2:
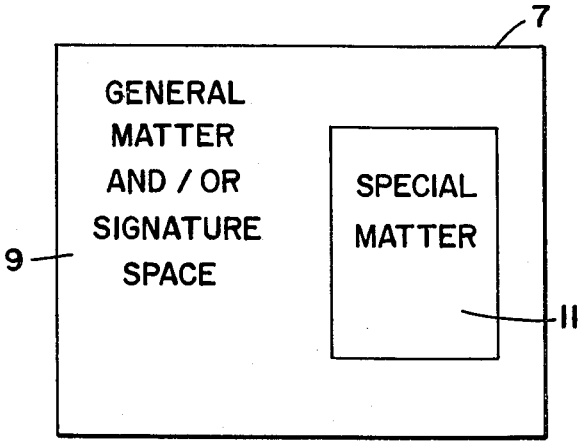
FIG. 2 is a diagram of a second chart bearing the same and similar information as the first chart in FIG. 1, and intended to be used in conjunction therewith.

In the embodiments of FIGS. 1 through 3, the signing or other inspection indicia provided on the second chart 7, 7' serves as record evidence of compliance with applicable laws, regulations, or the like. It also evidences to the employer or other responsible entity that the monitoring function is being performed.

Where a single employer or other responsible entity utilizes first aid kits or the like, some of which have different fills than others; or, where a manufacturer of first aid kits supplies a variety of different fills according to customer needs, it is desirable for the general information or other matter appearing in the first regions 3, 3' and 9, 9' of first and second charts 1, 1' and 7, 7', to be pre-printed in bulk as forms or the like having one or more blank spaces in the first regions 5, 5' and 11, 11'. These blank spaces are then filled in according to the specifications of each particular first aid kit or the like. The first or primary printing step can be done by any known printing process, since it is normally done in large enough volume that conventional printing set up costs are easily absorbed. However, the secondary printing of a special matter must often be done in very low volume, so it is necessary to print this subject matter by a printing process where set up costs are not a significant factor.

Figure 4A:
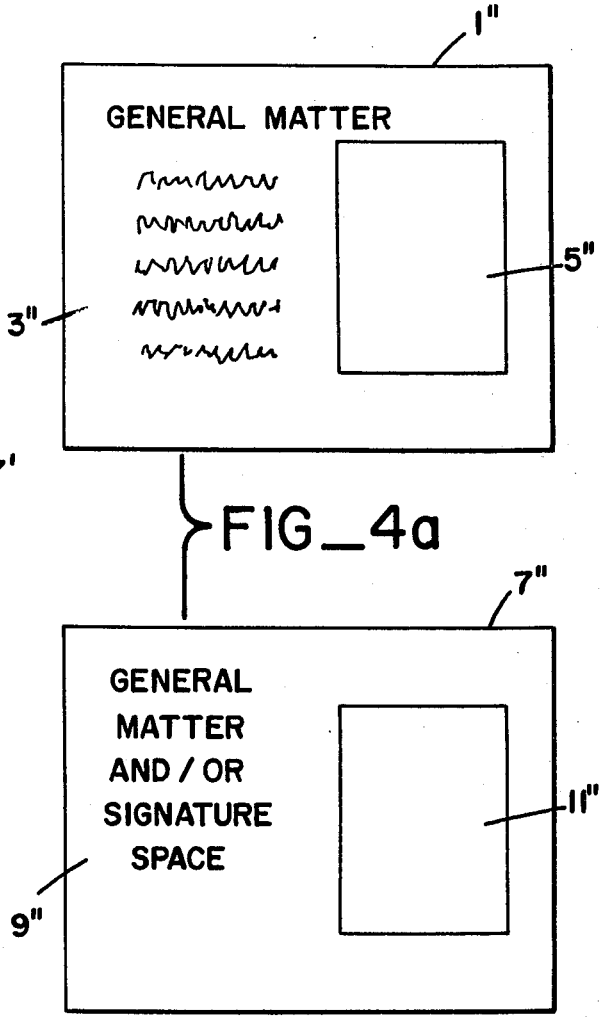
FIG 4*a* illustrates a pre-printed blank for the charts shown in FIGS. 1 and 2 wherein the regions for printing special matter have been left blank.
Figure 4B:
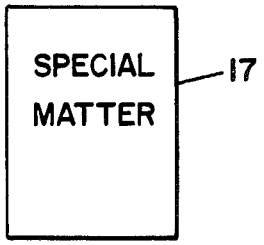
FIG. 4*b* depicts a master sheet containing special matter for inclusion in the blanks of the charts shown in FIG. 4*a*.
Figure 4C:
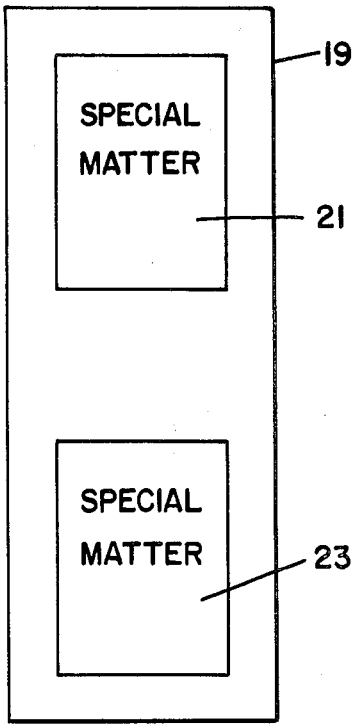
FIG. 4*c* is an alternate embodiment of the master sheet shown in FIG. 4*b* and is suited for use in conjunction with preprinted blanks for the first and second charts of 4*a* and 4*b* wherein such charts are carried on a single sheet, as illustrated by FIG. 3, for subsequent detachment.
Figure 4D:
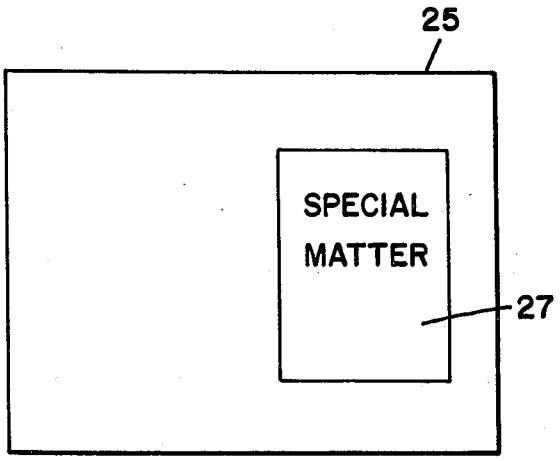
FIG. 4*d* is an alternate embodiment of the master sheet illustrated in FIG. 4*b* wherein the special matter is printed in a certian location on a sheet corresponding in size to the pre-printed blanks shown in FIG. 4*a*.
Figure 4E:
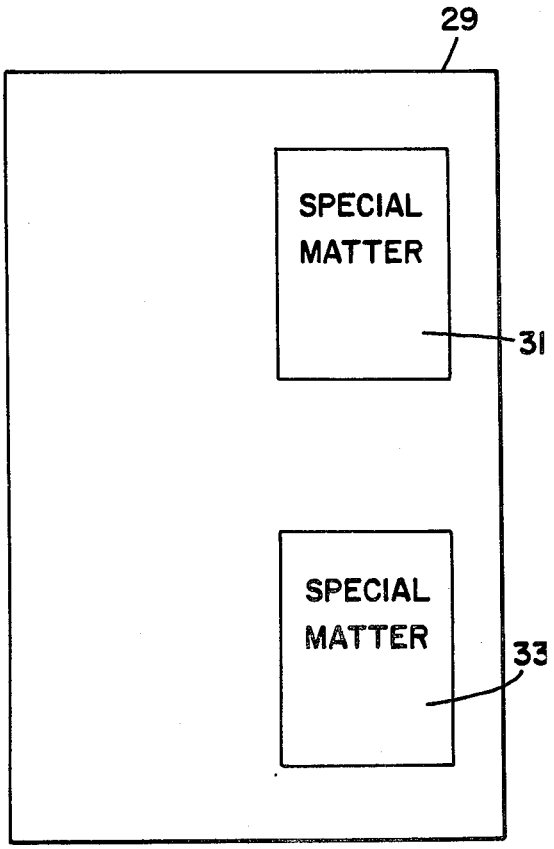
FIG. 4*e* illustrates a further alternate embodiment of the master sheet shown in FIG. 4*b* wherein the special matter is printed at two selected locations on a single sheet corresponding in size to the sheet of FIG. 3.

Thus, as is shown in FIG. 4a (wherein common elements of prior embodiments are depicted by like numerals twice primed), forms of the first and second charts 1'' and 7'' are printed bearing the general matter and/or signature space in the first regions 3'' and 9'' respectively. The second regions 5'' and 11'' for special matter have been left blank.

Special matter to be printed in the second regions 5, 5' and 11, 11' is prepared by first typing or otherwise printing a master fill sheet 17 bearing such special matter, as shown in FIG. **4*b***.

The first and second forms 1'' and 7'' are on thin flexible material suitable to be printed on by a dry electrostatic copier, such as a copier Model 3600 I, manufactured and sold by Xerox Corporation, Rochester, N.Y. The forms 1'' and 7'' are thus placed at the to-be-printed station of the copier, and the master sheet 17 is placed in the to-be-copied window of the copier machine at a location corresponding to the blank spaces 5'' and 11'' on the blank forms 1'' and 7''. The copier is then activated whereupon the special matter appearing on the master sheet 17 is copied into the blank spaces 5'' and 11'', thereby providing completed first and second charts for use in the first aid kit monitoring system described above.

It will be apparent that the foregoing electrostatic copying technique is equally suitable to the second embodiment of the present invention illustrated by FIG. 3 wherein the first and second charts 1' and 7' are provided on a single sheet 13. In such embodiment, the master sheet 17 could be a single sheet 19 of the type illustrated by FIG. **4*c* wherein duplicte versions 21 and 23 of the special matter are provided at locations corresponding to the location of the blank second regions 5' and 11' of the pre-printed form 13.**

In an alternate embodiment illustrated by FIG. **4*d* the special matter is printed on a master sheet 25 which is otherwise blank and which corresponds in size and arrangement to the pre-printed form 1'' and/or 7''. This provides a means whereby the special matter 27 is easily placed in registry with the blank second regions 5'' and 11'' of the pre-printed 1'' and 7''** during he electrostatic copying process.

Similarly, where the first and second charts 1 and 7 are to be printed on a single sheet 13 as shown in FIG. 3, the master sheet may be prepared as shown in FIG. 43 where the special material is printed at two locations 31 and 33 on a blank sheet 29 corresponding in size to the sheet 13. The sizes and locations 31 and 33 of the special material correspond to the sizes and locations of the second regions 5' and 11'.

It will be seen from the foregoing, that the charts of the present invention are suited for a first or primary printing of general matter in high volume and of relatively high quality such as by photo-offset, lithograph, letterpress or the like. This primary printing could be in multiple colors for color coding or the like. The special information is thereafter provided in a secondary printing step, which is customarily carried out in low volume runs, on a dry electrostatic copier in black and white, thereby providing relatively low quality printing in comparison to the primary printing step.

The foregoing procedure is suitable for printing virtually any chart, or other printed matter which it may be anticipated may require frequent revisions of matter appearing in certain regions of the printed sheet (such as price lists or the like) or where a variety of modifications in or other versions of a basic printed form may be desired.

I claim:

1. A system for monitoring the contents of a plurality of first aid kits, a first given number of which have different desired contents from a second given number thereof comprising the steps of:

a. printing a quantity of first charts which is many times greater than said plurality of first aid kits, each of said first charts having first and second regions thereon, said first region thereof carrying first printed matter common to all of said first charts and said second region thereof being blank;

b. printing a quantity of second charts which is many times greater than said plurality of first aid kits, each of said second charts having first and second regions thereon, said first region thereof carrying second printed matter common to all of said second charts and said second region thereof being blank;

c. printing a list of the desired contents of said first given number of first aid kits in said second region of a first given number of said first charts which is many times greater than said first given number of said plurality of first aid kits and printing a list of the desired contents of said second given number of first aid kits in said second region of a second given number of said first charts which is many times greater than said second given number of said plurality of first aid kits;

d. printing said list of the desired contents of said first given number of said plurality of first aid kits in said second region of a first given number of said second charts which is many times greater than said second given number of said plurality of first aid kits and printing said list of the desired contents of said second given number of said plurality of first aid kits in said second region of a second given number of said second charts which is many times greater than said second given number of said plurality of first aid kits;

e. providing each of said first given number of said quantity of first charts with a different serial number and providing each of said first given number of said quantity of second charts with a serial number identical to a different one of said serial numbers of said first given number of said quantity of first charts;

f. providing each of said second given number of said quantity of first charts with a different serial number and providing each of said second given number of said second charts with a serial number identical to a different one of said serial numbers of said second given number of said quantity of first charts;

g. periodically transporting to one of said first given number of first aid kits one of said first given number of said quantity of first charts and one of said first given number of said quantity of second charts bearing identical serial numbers, comparing the contents of said one of said first given number of first aid kits to said list of desired contents thereof in said second regions of said ones of said first given numbers of said quantities of first and second charts, marking said ones of said first given numbers of said quantities of first and second charts to indicate items missing from said one of said first given number of first aid kits, signing, dating and filing said one of said first given number of said quantity of first charts in a central file, placing said one of said first given number of said quantity of second charts in said one of said first given number of first aid kits; and h. periodically transporting to one of said second given number of first aid kits one of said second given number of said quantity of first charts and one of said second given number of said quantity of second charts bearing identical serial numbers, comparing the contents of said one of said second given number of first aid kits to said list of contents thereof in said second regions of said ones of said second given numbers of said quantities of first and second charts, marking said ones of said second given numbers of said quantities of first and second charts to indicate items missing from said one of said second given number of first aid kits, signing, dating and filing said one of said second given number of said first charts in a central file, placing said one of said second given number of said quantity of second charts in said one of said second given number of first aid kits.

2. The monitoring system of claim 1 wherein each of said quantity of first charts is printed on a single sheet together with a different one of said quantity of second charts for subsequent detachment from each other.

* * * * *